US005547245A

United States Patent [19]

Knouse

[11] Patent Number: 5,547,245

[45] Date of Patent: Aug. 20, 1996

[54] RECLINER CHAIR

[76] Inventor: Bobby W. Knouse, 681 Co. Sq. Dr., #56, Ventura, Calif. 93003

[21] Appl. No.: 59,741

[22] Filed: May 12, 1993

[51] Int. Cl.[6] ..... A61G 15/00

[52] U.S. Cl. ..... 297/85; 297/84; 297/411.33; 297/411.36; 297/151; 5/646

[58] Field of Search ..... 297/411.33, 411.35, 297/411.36, 411.38, 68, 84, 85, 423.3, 423.31, 151, 153; 5/618, 86.1, 39, 646

[56] References Cited

U.S. PATENT DOCUMENTS

| | | | |
|---|---|---|---|
| 8,377 | 9/1851 | O'Neil | 297/411.38 X |
| 1,617,108 | 2/1927 | Gursky . | |
| 2,281,813 | 5/1942 | Uline | 297/151 |
| 2,615,497 | 10/1952 | Luckhardt | 297/84 |
| 2,712,344 | 7/1955 | Weber . | |
| 2,986,200 | 5/1961 | Nobile | 297/411.38 X |
| 4,099,776 | 7/1978 | Crum et al. . | |
| 4,113,305 | 9/1978 | Hampton . | |
| 4,216,992 | 8/1980 | Crum . | |
| 4,306,746 | 12/1981 | Crum . | |
| 4,352,523 | 10/1982 | Holobaugh, Jr. . | |
| 4,492,407 | 1/1985 | Broadhead . | |
| 4,577,902 | 3/1986 | Crum . | |
| 4,591,205 | 5/1986 | James . | |
| 4,632,450 | 12/1986 | Holdt | 297/84 |
| 4,662,673 | 5/1987 | Crum . | |
| 4,669,135 | 6/1987 | Gonzalez | 297/85 |
| 4,678,229 | 7/1987 | Ryan et al. . | |
| 4,747,170 | 5/1988 | Knouse . | |
| 4,936,628 | 6/1990 | Delaney | 297/153 X |
| 4,949,408 | 8/1990 | Trkla | 5/86.1 |
| 4,974,905 | 10/1990 | Davis | 5/618 X |
| 5,056,862 | 10/1991 | May | 297/85 |

FOREIGN PATENT DOCUMENTS 1211807 11/1970 United Kingdom .

*Primary Examiner*—Peter M. Cuomo
*Assistant Examiner*—David E. Allred
*Attorney, Agent, or Firm*—Kelly, Bauersfeld & Lowry

[57] ABSTRACT

An improved recliner chair is provided of the type having a recliner linkage for controlled movement of a seat and seatback through a sequence of substantially upright and reclined positions, wherein the recliner linkage is further adapted for movement of the seat and seatback to a substantially coplanar horizontal position. The chair includes the recliner linkage for movably supporting the seat and seatback with respect to a chair frame in a manner permitting normal movement from an upright position to one or more reclined positions. A releasable latch assembly permits further reclination movement of the seat and seatback to the substantially horizontal position. The chair is particularly suited for use in a patient care facility, with the horizontal position permitting facilitated patient transfer between a bed and the recliner chair.

15 Claims, 5 Drawing Sheets

FIG. 3
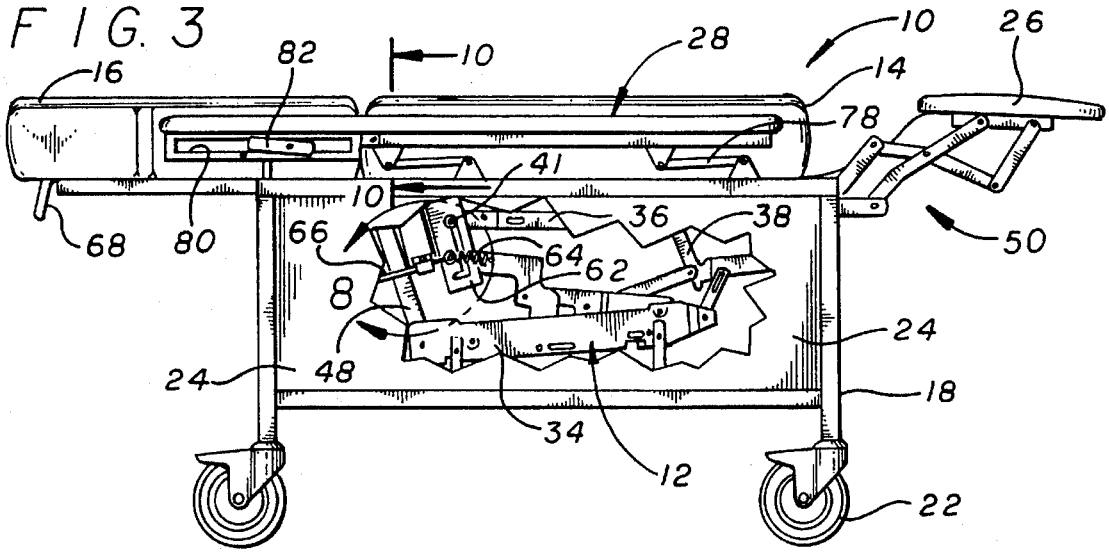
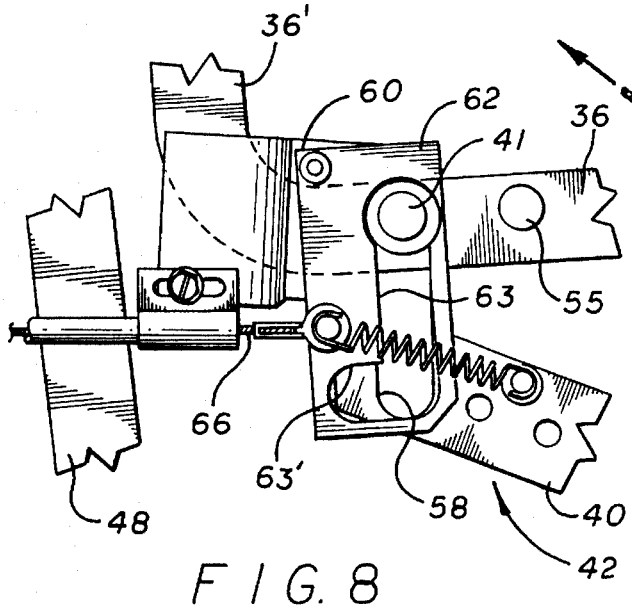
FIG. 8
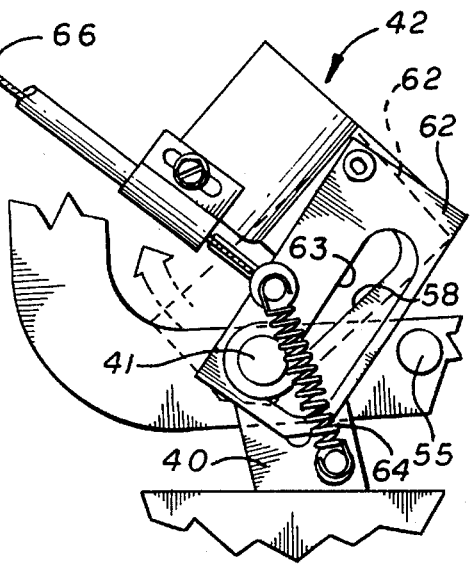
FIG. 9
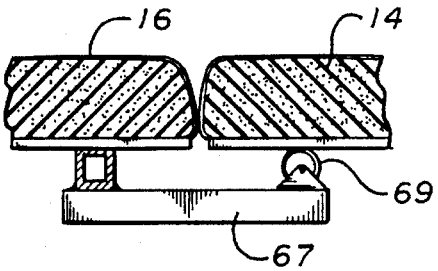
FIG. 11
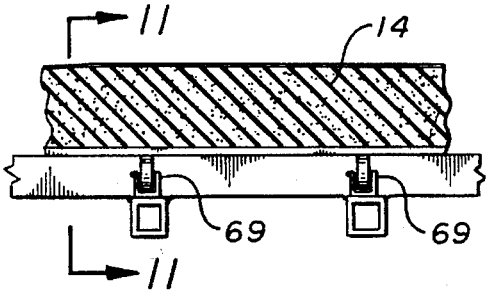
FIG. 10

FIG. 12
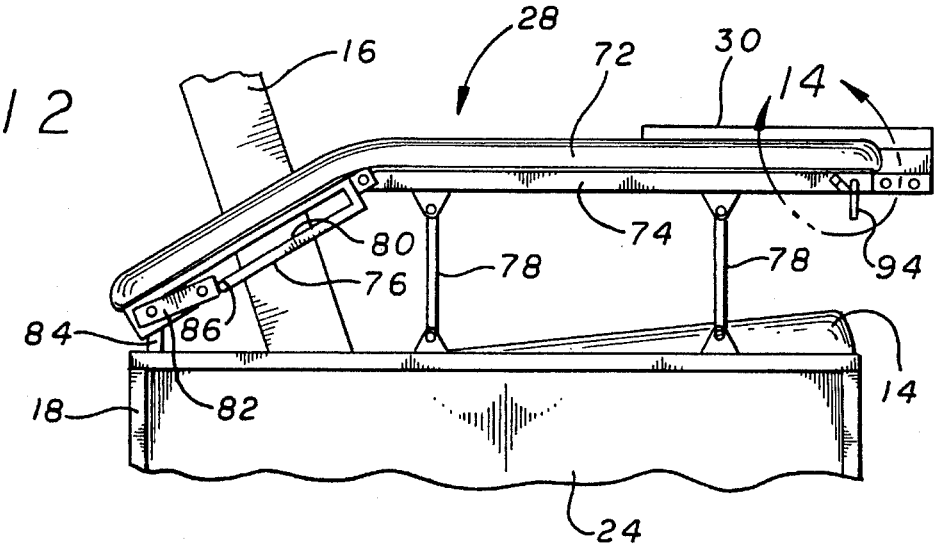
FIG. 13
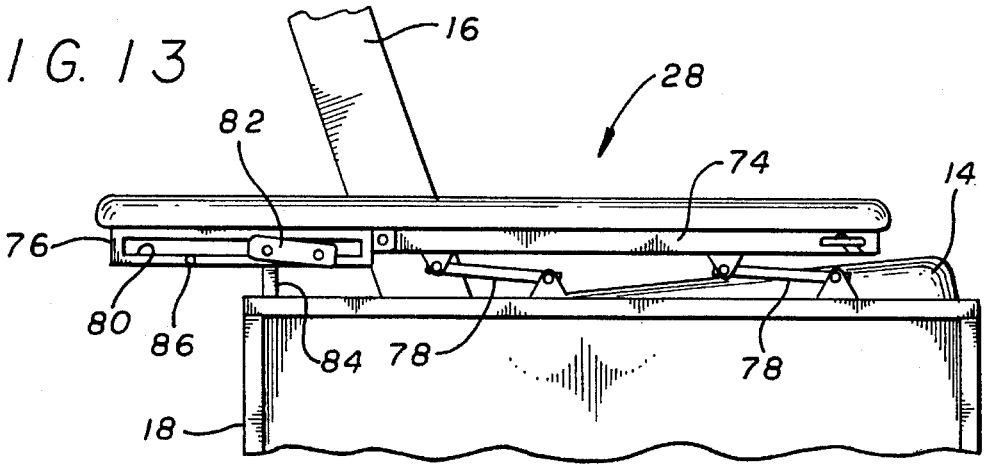
FIG. 14
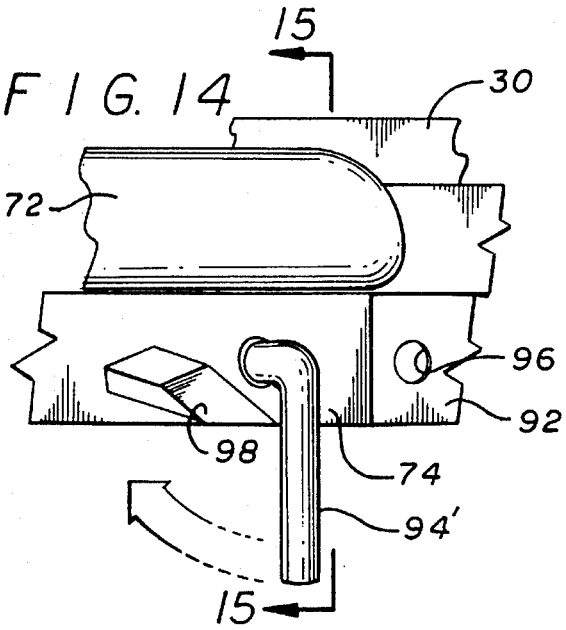
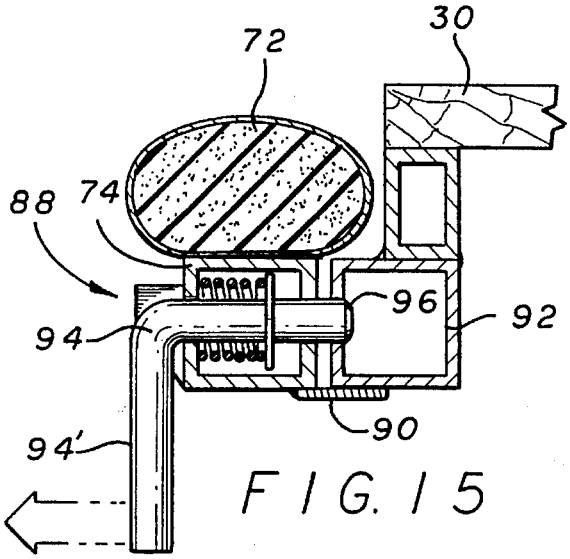
FIG. 15

RECLINER CHAIR

BACKGROUND OF THE INVENTION

This invention relates generally to recliner chairs of the type having a seat and seatback supported on a chair frame for movement through a sequence of upright and reclined positions. More particularly, this invention relates to an improved recliner chair adapted for movement of the seat and seatback to a substantially coplanar horizontal position.

Recliner chairs are generally known in the art for comfortably supporting a person in two or more different seated orientations. More specifically, recliner chairs include a mechanical recliner linkage for movably supporting a seat and seatback with respect to a chair frame, in a manner permitting movement of the seat and seatback from a substantially upright position to one or more reclined positions. In the upright position, the seat and seatback are typically oriented substantially perpendicular to each other, with the seat disposed in a horizontal or near-horizontal orientation. By contrast, in a reclined position, the seat and seatback are normally reclined or tilted rearwardly, frequently in association with movement of the seat and seatback to an oblique angular relation. In many instances, the recliner linkage is designed to accommodate movement of the seat and seatback to discrete partial- and full-reclined positions. A legrest is typically provided for movement to an elevated position in response to reclination movement of the seat and seatback. For one example of a recliner linkage of this general type, see U.S. Pat. No. 4,306,746, which is incorporated by reference herein.

While recliner chairs of the general type described above provide versatile and comfortable leisure seating, attainment of a substantially flat or coplanar horizontal orientation of the seat and seatback has not been possible. Instead, in a so-called fully reclined position, the chair seat and seatback have both been positioned at a substantial tilted angle. When and if a person desires to lay flat, it has been necessary for the person to vacate the chair in favor of a bed or the like.

In a patient care facility, recliner chairs are frequently used for comfortably supporting a patient in an upright or partially upright position in the course of daily activities such as eating, reading, watching television, etc. In this regard, it has been necessary for the patient to physically get out of bed in order to occupy the recliner chair, and vice versa. Unfortunately, as a result of physical strength limitations or ambulatory restrictions, many patients require the assistance of several facility staff members to move between the patient's bed and a recliner chair. Power-operated patient mover devices such as that described in U.S. Pat. No. 4,747,170 have been ineffective for this purpose since the recliner linkage has not permitted orientation of the chair seat and seatback in a flat horizontal position.

The present invention provides an improved recliner chair having a recliner linkage adapted for movement of the chair seat and seatback to a substantially coplanar horizontal position, thereby facilitating patient transfer between the recliner chair and the patient's bed particularly with the use of a power-operated patient mover device of the type described in U.S. Pat. No. 4,747,170. Subsequent to patient transfer, the recliner linkage may be operated normally to support the patient in a selected one of the upright or reclined positions.

SUMMARY OF THE INVENTION

In accordance with the invention, an improved recliner chair includes a recliner linkage supporting a chair seat and seatback for movement with respect to a chair frame between a generally upright position and one or more reclined positions. The recliner linkage includes a releasable latch assembly which permits further pivoting motion of the seat and seatback from a fully reclined position to a substantially coplanar horizontal position. In this horizontal position, the improved recliner chair is particularly suited for facilitated transfer of a patient between the recliner chair and a bed.

In the preferred form, the chair frame is supported on wheels for relatively smooth and easy rolling movement in a patient care environment. The recliner linkage is mounted on the chair frame and structurally supports the chair seat and seatback for movement to a plurality of different positions supporting a person. The preferred recliner linkage comprises a known so-called three-way recliner mechanism for movement from a generally upright position with the seat and seatback oriented substantially perpendicular, to an intermediate or partially reclined position, and further to a so-called fully reclined position. In the partial- and full-reclined positions, the seat and seatback are tilted rearwardly. Moreover, in the fully reclined position, the seat and seatback are oriented at an oblique angle. The recliner mechanism conventionally includes a legrest linkage for moving a legrest to an elevated position as the chair is reclined.

The releasable latch assembly comprises a manually operable latch lever connected via a cable or the like to a latch plate disposed generally at a rear end of the chair seat. The latch plate releasably engages a cam pin movable with the chair seat to retain the cam pin in a normal position defining a pivot point for normal operation of the recliner linkage between the upright and reclined positions. Retraction of the latch plate from the cam pin permits the cam pin to ride upwardly within the limits of a cam slot to reorient the seat in a substantially horizontal position, in response to further reclination movement of the seatback from the fully reclined position to a substantially horizontal position oriented generally coplanar with the seat. One or more lift bars on the seatback are provided to engage and lift a rear edge of the seat as the seatback is moved to the horizontal position, thereby positively displacing the seat to the desired coplanar horizontal position. In this substantially horizontal position of the seat and seatback, a person may be transferred between a bed and the recliner chair with relative ease. Thereafter, re-elevation of the seatback toward the normal upright position is accompanied by downward movement of the cam pin within the cam slot, with spring-loaded re-engagement of the latch plate with the cam pin for normal multi-positional operation of the recliner linkage.

In accordance with further aspects of the invention, the improved recliner chair includes armrest units at one or both sides of the chair frame. Each armrest unit comprises a pivoting armrest carried at the upper end of a pair of parallel support links for movement between a normal upper or elevated position disposed above the chair seat, and a lower position generally coplanar therewith to avoid interference with patient transfer to or from the recliner chair. Lock means are provided for releasably locking the arm rest unit in the elevated position.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is a side elevational view of the improved recliner chair, depicting a seat and seatback oriented in a substantially coplanar horizontal position;

FIG. 8 is an enlarged fragmented side elevational view corresponding generally with the encircled region 8 of the FIG. 3, and illustrating a releasable latch assembly in an unlatched condition;

FIG. 9 is an enlarged fragmented side elevational view similar to FIG. 8, and illustrating components of the releasable latch assembly in a normal latched condition;

FIG. 10 is a fragmented vertical sectional view taken generally on the line 10—10 of FIG. 3;

FIG. 11 is a fragmented vertical sectional view taken generally on the line 11—11 of FIG, 10;

FIG. 12 is an enlarged fragmented side elevational view depicting an armrest unit at one side of the recliner chair, and illustrating the armrest unit in a normal elevated position;

FIG. 13 is a fragmented side elevational view similar to FIG. 12, and illustrating the armrest unit in a lowered position;

FIG. 14 is an enlarged fragmented side elevational view corresponding generally with the encircled region 14 of FIG. 12; and FIG. 15 is an enlarged fragmented vertical section taken generally on the line 15—15 of FIG. 14,

DETAILED DESCRIPTION OF THE PREFERRED EMBODIMENT

Figure 1:
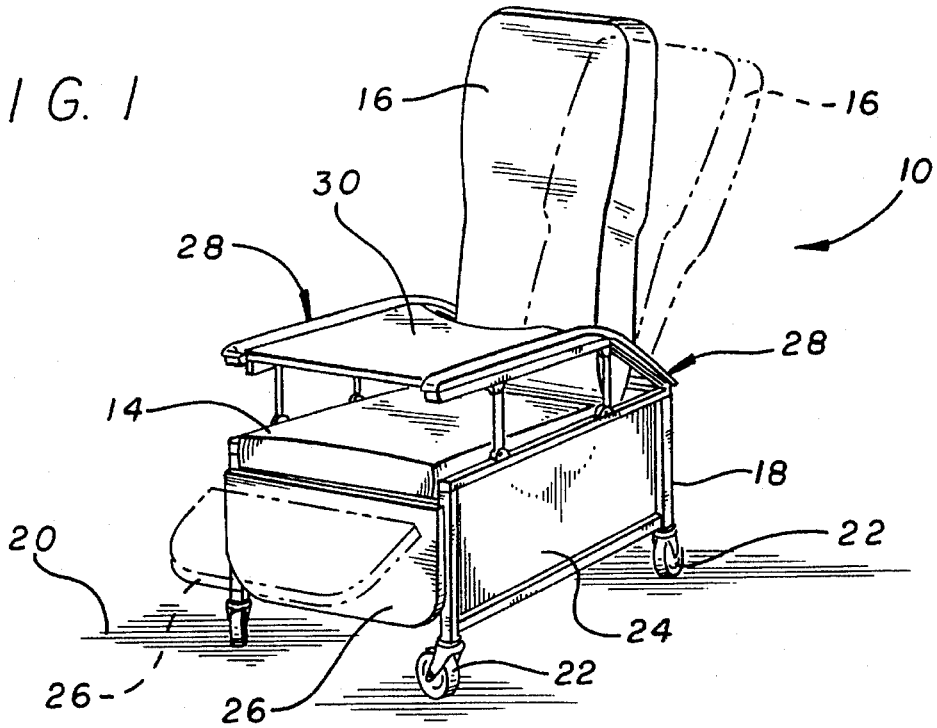
FIG. 1 is a front perspective view illustrating an improved recliner chair embodying the novel features of the invention.
Figure 2:
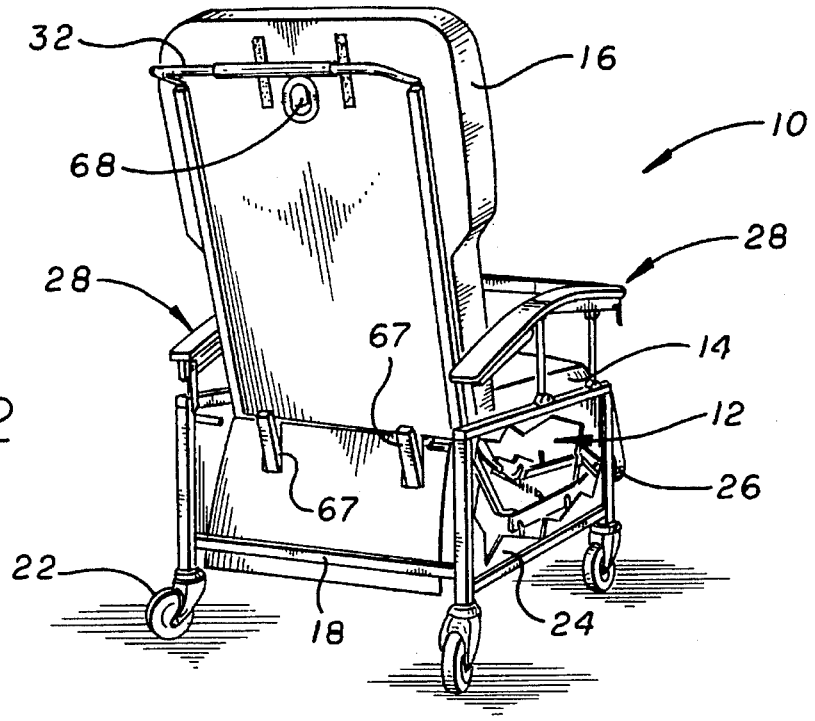
FIG. 2 is a rear perspective view of the recliner chair shown in FIG. 1, with portions broken away to illustrate a recliner linkage.

As shown in the exemplary drawings, an improved recliner chair referred to generally by the reference numeral 10 in FIGS. 1–3 is provided for comfortably supporting a person in one of a plurality of different seated positions. The recliner chair 10 includes a recliner linkage 12 (FIGS. 2 and 3) for movably supporting a chair seat 14 and a seatback 16 with respect to a chair frame 18, wherein the recliner linkage is adapted for selective orientation of the seat 14 and seatback 16 in a substantially coplanar horizontal position as viewed in FIG. 3.

The improved recliner chair 10 of the present invention is particularly designed for use in a patient care facility or similar patient care environment. In this regard, the chair frame 18 comprises a rigid chair base structure supported for rolling movement over a floor 20 by means of a plurality of caster wheels 22. The chair 10 can be used to comfortably support a patient or the like in an upright or a selected reclined position throughout the course of normal daily activities, while permitting the patient to be moved about with relative ease. Importantly, the recliner linkage 12 is modified from a conventional geometry to permit the seat 14 and seatback 16 to be placed in the horizontal flat position (FIG. 3) to facilitate patient transfer between the recliner chair 10 and a patient bed (not shown). In this regard, the recliner chair 10 of the present invention is particularly useful with patients having insufficient strength or ambulation for independent movement between the chair 10 and a patient bed. Power-operated patient transfer is conveniently available through the use of power-driven transfer mechanisms of the type described, for example, in U.S. Pat. No. 4,747,170.

In general terms, the recliner chair 10 comprises the linkage 12 for movably supporting the seat 14 and seatback 16 with respect to the rigid chair frame 18. The recliner linkage 12 comprises a conventional multi-position recliner mechanism having counterpart linkages mounted at opposite sides of the chair frame 18 in a position generally beneath the seat 14, and concealed from view at the inboard sides of a pair of chair side panels 24. The linkage mechanism may conform, for example, with a known prior art recliner linkage of the type shown and described, for example, in U.S. Pat. No. 4,306,746, which is incorporated by reference herein. In normal operation of the recliner linkage, the seat 14 and seatback 16 are oriented substantially perpendicular to each other, with the seat 14 typically disposed in a horizontal or near-horizontal position. A legrest 26 operated by the recliner linkage is normally retracted to a substantially vertical orientation at the front of the chair frame. From this normal position, as shown in solid lines in FIGS. 1 and 2, the seat 14 and seatback 16 may be reclined, while the legrest 26 is elevated to a substantially horizontal orientation at the front of the chair as depicted in dotted lines in FIG. 1. Armrest units 28 at opposite sides of the chair frame 18 are normally elevated in spaced relation above the seat 14, and may support a removable patient tray 30. In addition, a push bar 32 (FIG. 2) may be provided across the back of the seatback 16 for facilitated maneuvering and repositioning of the chair 10.

Figure 4:
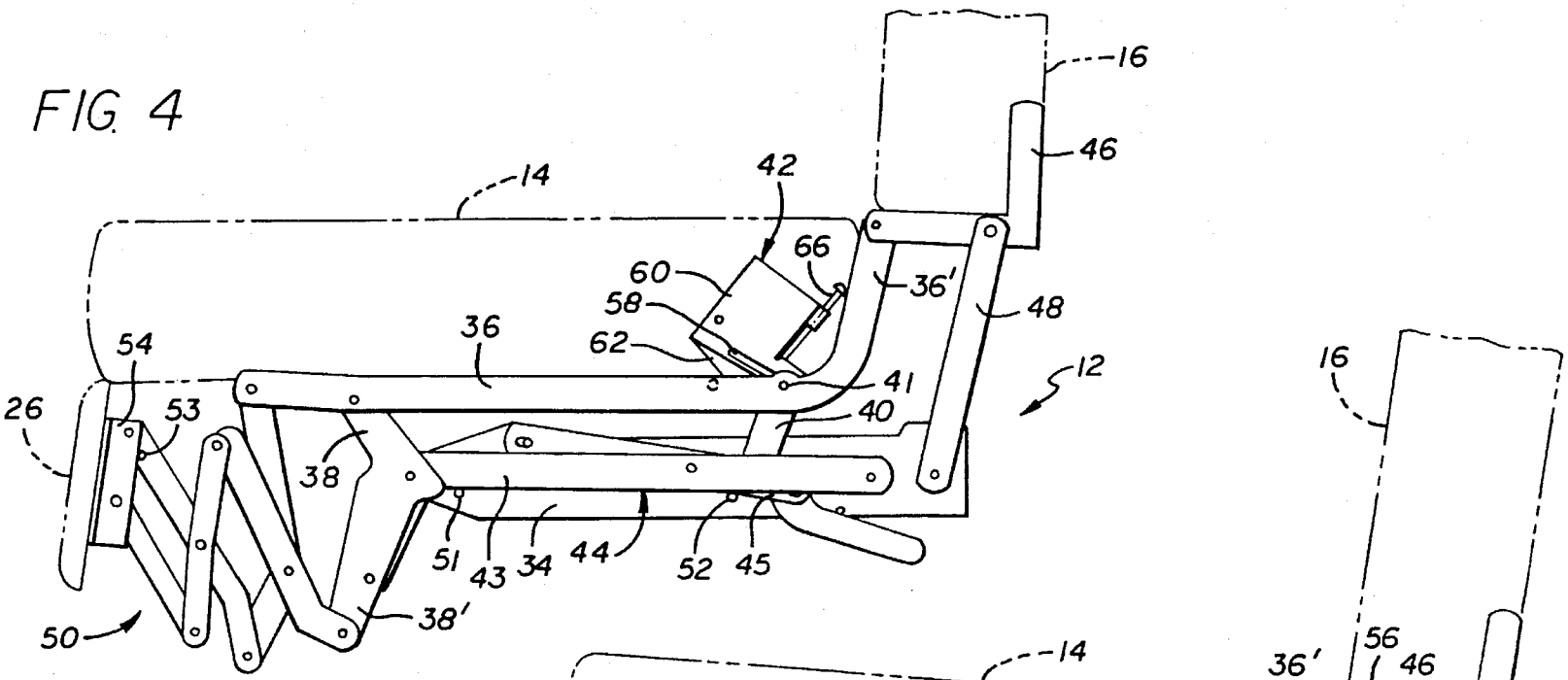
FIG. 4 is an enlarged fragmented side elevational view, shown somewhat in schematic form, and depicting the recliner linkage in a normal upright position.
Figure 5:
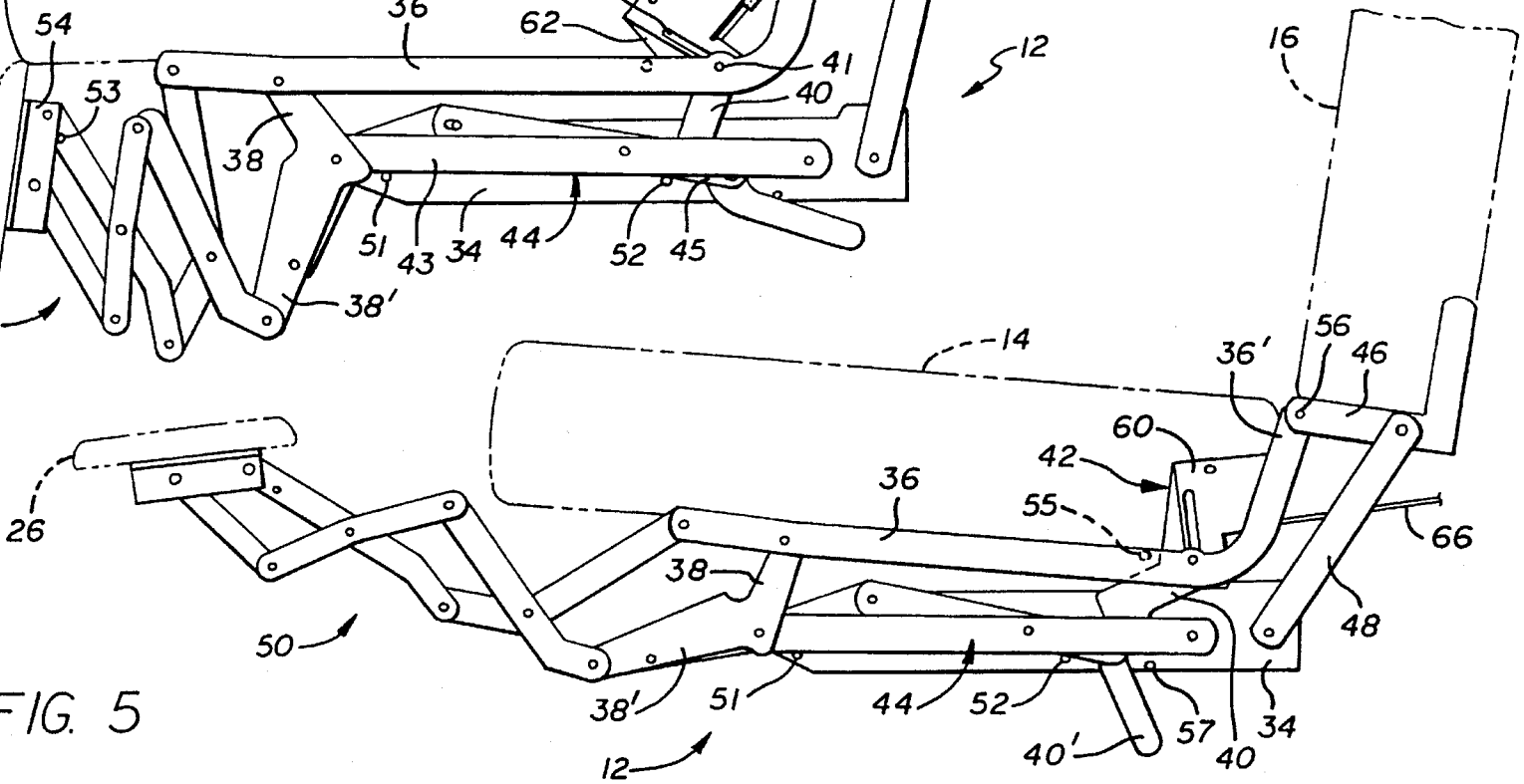
FIG. 5 is a fragmented side elevational view similar to FIG. 4, and depicting the recliner linkage in a partially reclined position.

In normal operation of the recliner linkage 12, in accordance with the linkage construction shown in the illustrative drawings, the seat and seatback may be reclined from the generally upright position as viewed in FIG. 4 to an intermediate or partially reclined position as depicted in FIG. 5, with the legrest 26 in an elevated position at the front of the chair. The linkage 12 may then be reclined further to a so-called fully reclined position as viewed in FIG. 6. Such reclination movement tilts a forward edge of the seat 14 upwardly with respect to a rear seat edge, while tilting rearwardly an upper edge of the seatback 16. Moreover, as the seat components are moved to the fully reclined position (FIG. 6), the seat and seatback are reoriented to a substantial oblique angular relation. Such displacement of the recliner linkage may be accomplished by the person sitting in the chair primarily as a result of shifting of the person's weight relative to the chair frame 18, and/or by pushing forwardly on the armrest units 28. Alternately, recliner linkages of this type are known wherein displacement of the linkage to the partially reclined position may be performed with the aid of an external pivot handle (not shown) mounted on the chair frame.

Figure 6:
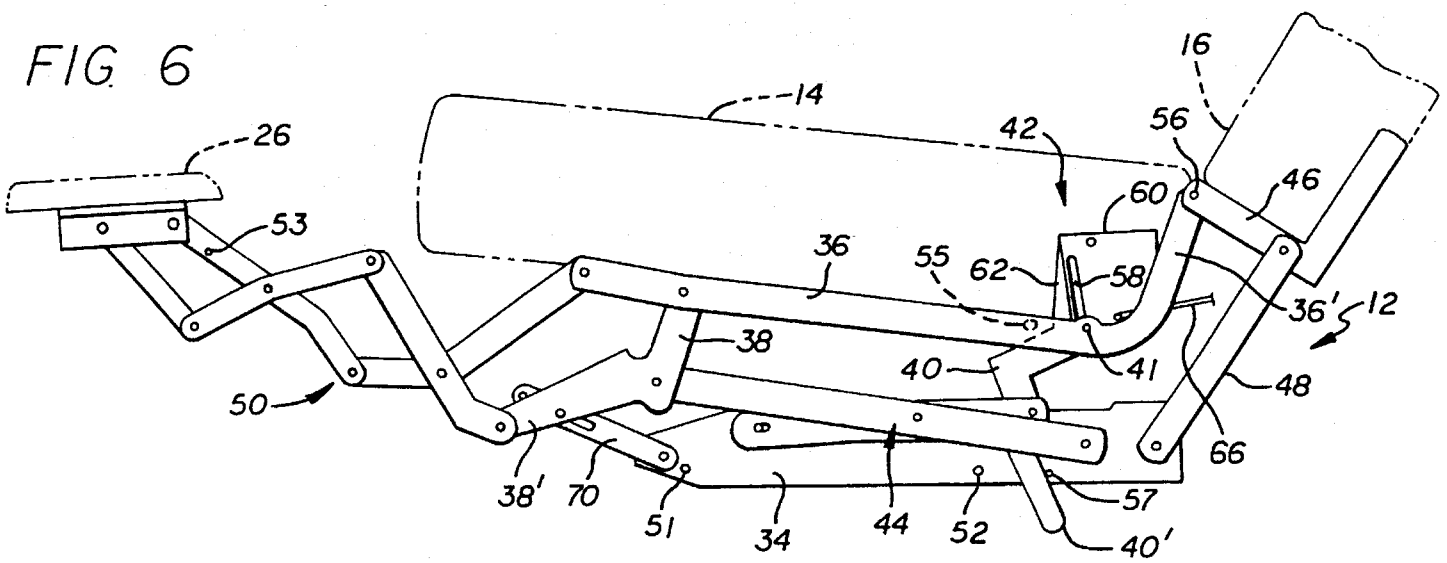
FIG. 6 is a fragmented side elevational view similar to FIGS. 4 and 5, and showing the recliner linkage in a so-called fully reclined position.

More particularly, with specific reference to the illustrative linkage depicted in FIGS. 4–6, the recliner linkage 12 comprises a base link 34 adapted for fixed connection to the chair frame 18. The base link 34 comprises a fixed support structure for mechanically supporting an upper seat link 36 connected to one side of the chair seat 14, for controlled movement between the upright and reclined positions.

As shown, the seat link 36 is pivotally connected to and supported by front and rear carrier links 38 and 40, wherein the rear carrier link 40 is pivotally connected to the seat link 36 by means of a cam pin 41 forming a portion of a releasable latch assembly 42, as will be described in more detail. A lower end of the front carrier link 38 is pivotally connected to a forward end of one link 43 of an X-frame linkage 44 (shown best in FIG. 6), wherein the rear end of the link 43 is pivoted to the base link 34 at a position spaced below the cam pin 41. The opposite link 45 of the X-frame linkage 44 has a rear end pivoted to the rear carrier link 40 and a front end pivoted to the base link 34. The X-links 43 and 45 are in turn centrally pivoted to each other.

In the normal upright position, as viewed in FIG. 4, the pivot points connecting the carrier links 38 and 40 to the seat link 36 are disposed forwardly of the carrier link pivot points with the X-frame linkage 44. Thus, when a person is seated in the chair 10, the person's body weight acting downwardly on the seat 14 effectively retains the recliner linkage 12 in the upright position. As shown, in the upright position, the seat and seatback are oriented at approximately a right angle, with the seat 14 disposed in a horizontal or near-horizontal attitude.

As shown in FIGS. 4 and 5, rearward displacement of the seat link 36 relative to the base link 34 causes the chair seat 10 to displace rearwardly with respect to the chair frame 18 toward the partially reclined position with increased fore-aft seat tilt angle. Such rearward displacement of the seat link 36 may be accomplished by the patient pushing forwardly on the armrest units 28, thereby causing the seatback 16 to shift rearwardly. A seatback link 46 mounted at one side of the seatback 16 has a forward end pivotally connected to an upturned rear end 36' of the seat link 36, and a rear end coupled to the base link 34 by a seatback pivot control link 48. The rearward motion of the seatback 16 is thus connected to and accompanied by a rearward motion of the seat 14, resulting in rearward displacement of the seat link 36. As shown in FIG. 5, in the partially reclined position, the carrier link pivot connections with the seat link 36 are displaced to positions behind the associated carrier link pivot points with the frame linkage 44, whereby the person's weight in the chair is again effective to retain the linkage 12 in the partially reclined position.

The forward carrier link 38 of the recliner linkage 12 has a lower extension 38' projecting downwardly and forwardly from the base link 34 for driving operation of a legrest linkage 50 having the legrest 26 mounted thereon. The legrest linkage 50 is shown to have a conventional interconnected Vee-type lazy tong construction, with links at the rear end pivotally connected to the drive link 38' and to a forward end of the seat link 36, respectively. Rearward shifting movement of the seat 14 thus actuates the leg rest linkage 50 for displacing the legrest 26 to an elevated position in the front of the chair 10.

The recliner linkage 12 includes mechanical stops to limit pivoting link movement between predefined upright and partially reclined positions. More particularly, as shown in FIGS. 4 and 5, a pair of primary stop pins 51 and 52 are mounted on the base link 34 for respectively supporting the free ends of the X-frame links 43 and 45. Similarly, a legrest stop pin 53 engages a support plate 54 (FIG. 4) when the legrest 26 is retracted to define a stop point for the entire linkage in the upright position. As the seat 14 is displaced rearwardly to the partially reclined position in association with legrest extension (FIG. 5), a shoulder on the rear carrier link 40 engages a secondary stop pin 55 on the seat link 36 to define a displacement stop point.

The recliner linkage 12 may be shifted further to the fully reclined position, as viewed in FIG. 6, in response to rearward application of the person's weight to shift the center of gravity to a position disposed behind a pivot point 56 (FIGS. 5 and 6) interconnecting the seatback link 46 with the seat link 36. When this occurs, the frame linkage 44 permits upward lifting and rearward tilting of the seat link 36, in coordination with relative further reclination movement of the seatback 16. A stop 57 on the base link 34 is engaged by an extended lower end 40' of the carrier link 40 to retain the linkage and chair components in the fully reclined position. Return shifting of the person's weight on the chair to a position forward of the pivot point 56 causes the linkage to shift back to the partially reclined position, shown in FIG. 5, and/or further to the upright position as viewed in FIG. 4, all in a manner known to persons skilled in the art.

Figure 7:
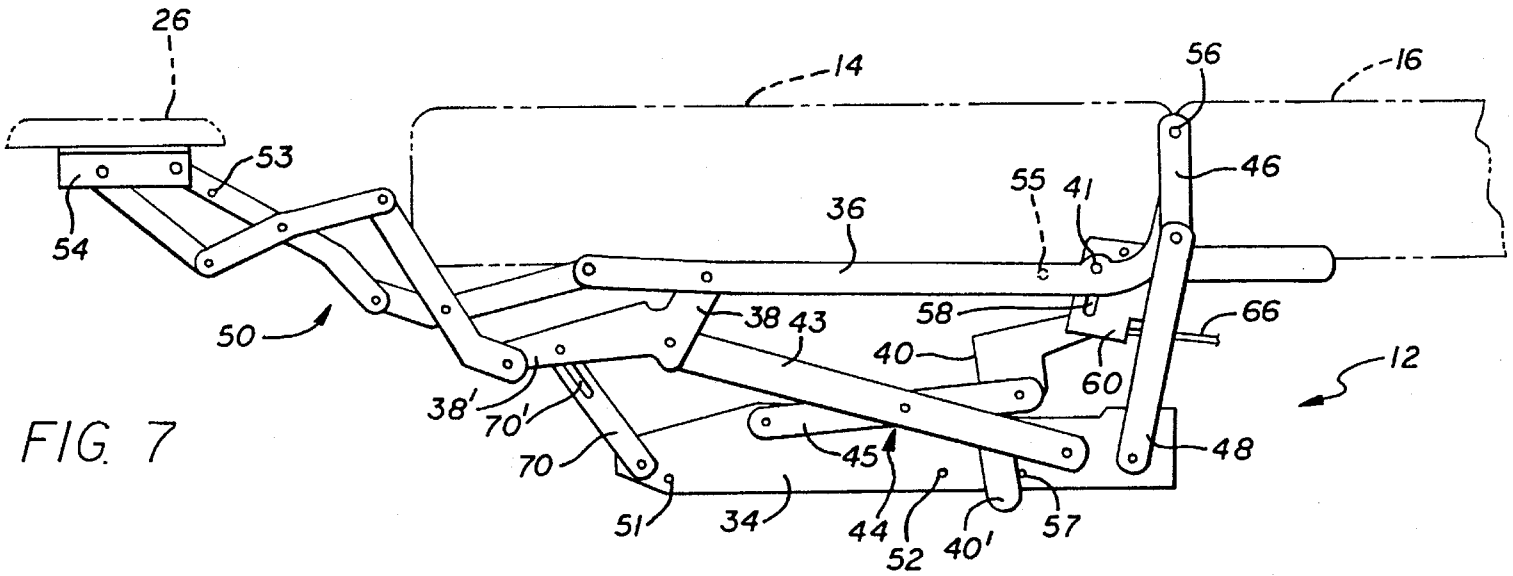
FIG. 7 is a fragmented side elevational view similar to FIGS. 4–6, and illustrating the recliner linkage supporting the chair seat and seatback in the substantially coplanar horizontal position.

In accordance with a primary aspect of the present invention, the illustrative recliner linkage 12 is adapted for movement to a further reclined position, with the seat 14 and seatback 16 disposed substantially horizontally in coplanar relation, as viewed in FIG. 7. In this regard, the cam pin 41 carried near the rear end of the seat link 36 is normally retained at a lower end of an elongated cam slot 58 formed in a cam plate 60 at an upper end of the rear carrier link 40. A latch plate 62 (FIGS. 7–9) is pivotally mounted to the cam plate 60 in overlying relation and has an L-shaped track 63 formed therein. The L-shaped track 63 has a primary segment having a size and shape conforming to the cam slot 58, and an offset notch 63' sized to receive and retain the cam pin 41. As shown in FIG. 9, a spring 64 connected between the latch plate 62 and the carrier link 40 normally retains the latch plate 62 in a position with the offset notch 63' capturing and retaining the cam pin 41 at a lower end of the slot 58 for conventional multi-position adjustment of the recliner, as viewed in FIGS. 4–6.

However, when it is desired to re-orient the seat 14 and seatback 16 to the substantially horizontal and coplanar position shown in FIG. 7, the latch plate 62 is retracted against the the spring 64 to align the primary segment of the L-shaped track 63 in direct overlying relation with the cam slot 58 (FIG. 8). In this position, the cam pin 4 1 is free to shift upwardly along the slot 58 for purposes of elevating the rear edge of the seat 14, as will be described.

Latch plate retraction is accomplished by means of a control cable 66 having one end connected to the spring 64 and extending therefrom to a movable latch lever 68 mounted, for example, at a central position behind the seatback 16 (FIG. 2). A single latch lever 68 may be provided to operate separate control cables connected to the recliner linkages at opposite sides of the chair, or separate latch levers may be provided. In either case, manual retraction of the latch lever 68 pulls the control cable 66 against the spring 64 to pivot the latch plate 62 in a manner permitting the cam pin 41 to ride upwardly within the cam slot 58. The length of the cam slot 58 is chosen to permit upward seat shifting to a substantially horizontal seat orientation, as viewed in FIGS. 3 and 7.

Concurrently with the above-described upward seat displacement to the horizontal position, the seatback 16 is further reclined to a substantially coplanar, horizontal position (FIGS. 3 and 7). In this regard, the seatback pivot control link 48 is appropriately offset to avoid interference with the rear upturned end 36' of the seat link 36. The linkage thus permits the seat and seatback to be placed in a substantially flat and horizontal orientation. A pair of lift bars 67 (FIGS. 2, 10 and 11) project downwardly from a lower edge of the seatback 16 and include rollers 69 at their lower most ends for engaging and positively lifting an under surface of the rear edge of the seat 14 to a horizontal orientation substantially coplanar with the seatback. Those lift bars 67 thus assist in assuring seat movement to the horizontal position and further serve to retain the seat in the desired horizontal position until return movement to a reclined or the upright chair position.

Movement of the seat and seatback to the coplanar horizontal orientation is accompanied by additional elevation of the legrest 26 to a position substantially coplanar with the seat. A forward stabilizer link 70 connected between the base link 34 and the drive link 38' has a lost motion slot 70' formed therein to define an end limit to legrest elevation. In the orientation shown in FIGS. 3 and 7, as previously described, a person may be transferred quickly and easily between the chair 10 and a bed.

The armrest units 28 are conveniently adapted for deployment between a normal elevated position at the sides of the chair seat 14, and individually lowered positions disposed substantially coplanar with the seat 14 to avoid interference with a patient transfer procedure. More particularly, as shown in FIGS. 12 and 13, each armrest unit 28 comprises a padded or upholstered structure 72 mounted onto a pivotally connected pair of armrest links 74 and 76. The forward armrest link 74 is pivotally interconnected to the underlying side panel 24 of the chair frame 18 by a pair of parallel support links 78. The rear armrest link 76 has a longitudinally elongated track 80 formed therein for slidable reception of a pivot latch 82 mounted at the upper end of a short support post 84 on a rear edge of the chair frame.

When the armrest unit 28 is elevated, as shown in FIG. 12, the forward armrest link 74 is disposed in spaced relation above the seat 14. The rear armrest link 76 is oriented to angle downwardly and rearwardly from the forward link 74, with the pivot latch 82 generally within a rear end of the track 80. In this position, the pivot latch 82 is adapted to rotate relative to the post 84 for slight misalignment with the track 80 and engagement with a stop 86 to retain the armrest unit in the elevated position. Manual rotation of the pivot latch 82 sufficient to clear the stop 86 permits the armrest 74, 76 to be pivoted rearwardly on the support links 78 to a lowered position (FIGS. 3 and 13). When the chair linkage is positioned in the flat bed geometry of FIG. 3, the lowered armrest unit 28 is conveniently disposed at an out-of-the-way position substantially coplanar with the seat 14.

FIGS. 14 and 15 show a convenient releasable tray lock assembly 88 designed to permit rapid mounting and removal of the patient tray on the armrest units 28. As shown, the forward armrest link 74 includes a short support tab 90 at an inboard edge thereof for supporting a side rail 92 on the patient tray 30. A spring-loaded latch pin 94 projects inwardly through the armrest link 74 for normal reception through an aperture 96 in the tray rail 92 to lock the tray 30 in place. The latch pin 94 has a downturned outboard end 94' which can be manually grasped and rotated to engage a ramped track 98 on the armrest link 74, for purposes of retracting the latch pin for the tray rail 92. Thus, the patient tray 30 can be removed quickly and easily from the chair whenever desired, such as preparatory to a patient transfer procedure as previously described.

The improved recliner chair 10 of the present invention thus provides a conventional multi-position chair adjustment between upright and one or more reclined positions for comfortably supporting a person. However, the recliner linkage is specially adapted for quick and easy adjustment to a flat bed position with the seat and setback disposed substantially horizontal and coplanar. With this construction, the chair 10 is particularly adapted for use in a patient care environment wherein patient transfer between the chair and a patient bed is required.

A variety of modifications and improvements to the recliner chair 10 of the present invention will be apparent to persons skilled in the art. Accordingly, no limitation on the invention is intended by way of the foregoing description and accompanying drawings, except as set forth in the appended claims.

What is claimed is:

1. A recliner chair, comprising:

a chair frame;

a seat;

a seatback; and a recliner linkage including a seat link mounted on said seat, and means for movably supporting said seat link and said seatback for movement between a generally upright position and at least one reclined position with said seat link tilted upwardly toward a front of the chair frame and with said seatback tilted rearwardly, said supporting means including a carrier link and means for pivotally connecting said carrier link generally to a rear end of said seat link;

said pivotally connecting means including latch means normally engaged for pivotally connecting said carrier link with said seat link so that said seat link follows said carrier link upon operation of said recliner linkage for movement between said upright and reclined positions;

said latch means being releasable to permit relative sliding displacement between said seat link and said carrier link for movement of said seat from said reclined position to a substantially horizontal position;

said recliner linkage further including means for permitting displacement of said seatback from said reclined position to a substantially horizontal position oriented substantial coplanar with said seat upon movement of said seat from said reclined position to said substantially horizontal position;

said latch means including a cam slot formed in said carrier link, a cam pin on said seat link and received within said cam slot, a spring-loaded latch member for releasably retaining said cam pin against relative displacement along said cam slot, and a manually operated latch lever for retracting said latch member from said cam pin to permit displacement of said cam pin along said cam slot, wherein said latch member comprises a latch plate pivotally mounted onto said carrier link, said latch plate having a notch therein for receiving and retaining said cam pin, a spring for biasing said latch plate in a direction receiving said cam pin within said notch, and a control cable connected between said latch plate and said latch lever for retracting said latch plate from said cam pin.

2. The recliner chair of claim 1 wherein said seatback includes at least one lift bar for engaging an undersurface of a rear edge of said seat upon movement of said seatback to said horizontal position for lifting said seat to said horizontal position substantially coplanar with said seatback.

3. The recliner chair of claim 1 wherein said seat and seatback are disposed in oblique relation when said seat and seatback are in said at least one reclined position.

4. The recliner chair of claim 1 further including a legrest, said recliner linkage including means for moving said legrest between a retracted position when said seat and seatback are in said generally upright position, and an elevated position when said seat and seatback are in said reclined position.

5. The recliner chair of claim 4 wherein said legrest moving means comprises means for orienting said legrest substantially coplanar with said seat when said seat and seatback are in said substantially coplanar horizontal position.

6. The recliner chair of claim 1 further including at least one armrest unit mounted on said chair frame for movement between a deployed position elevated above said seat at one side thereof, and a lowered position disposed substantially coplanar with said seat when said seat and seatback are in said substantially coplanar horizontal position.

7. The recliner chair of claim 6 including a pair of armrest units disposed at opposite sides of said seat, and further including a tray and means for removably mounting said tray to said armrest units.

8. A recliner chair, comprising:

a chair frame;

a seat;

a seatback;

a recliner linkage including a seat link mounted on said seat, and means for movably supporting said seat link and said seatback for movement between a generally upright position and at least one reclined position with said seat link tilted upwardly toward a front of the chair frame and with said seatback tilted rearwardly, said supporting means including a carrier link and means for pivotally connecting said carrier link generally to a rear end of said seat link;

said pivotally connecting means including latch means normally engaged for pivotally connecting said carrier link with said seat link so that said seat link follows said carrier link upon operation of said recliner linkage for movement between said upright and reclined positions;

said latch means being releasable to permit relative sliding displacement between said seat link and said carrier link for movement of said seat from said reclined position to a substantially horizontal position;

said recliner linkage further including means for permitting displacement of said seatback from said reclined position to a substantially horizontal position oriented substantial coplanar with said seat upon movement of said seat from said reclined position to said substantially horizontal position; and at least one armrest unit mounted on said chair frame for movement between a deployed position elevated above said seat at one side thereof, and a lowered position disposed substantially coplanar with said seat when said seat and seatback are in said substantially coplanar horizontal position.

9. The recliner chair of claim 8 including a pair of armrest units disposed at opposite sides of said seat, and further including a tray and means for removably mounting said tray to said armrest units.

10. A recliner chair, comprising:

a chair frame;

a seat;

a seatback; and a recliner linkage including a seat link mounted on said seat, and means for movably supporting said seat link and said seatback for movement between a generally upright position and at least one reclined position with said seat link tilted upwardly toward a front of the chair frame and with said seatback tilted rearwardly, said supporting means including a carrier link and means for pivotally connecting said carrier link generally to a rear end of said seat link;

said pivotally connecting means including latch means normally engaged for pivotally connecting said carrier link with said seat link so that said seat link follows said carrier link upon operation of said recliner linkage for movement between said upright and reclined positions;

said latch means being releasable to permit relative sliding displacement between said seat link and said carrier link for movement of said seat from said reclined position to a substantially horizontal position;

said recliner linkage further including means for permitting displacement of said seatback from said reclined position to a substantially horizontal position oriented substantial coplanar with said seat upon movement of said seat from said reclined position to said substantially horizontal position;

said seatback including at least one lift bar for engaging an undersurface of a rear edge of said seat upon movement of said seatback to said horizontal position for lifting said seat to said horizontal position substantially coplanar with said seatback;

wherein said latch means comprises a cam slot formed in said carrier link, a cam pin on said seat link and received within said cam slot, a spring-loaded latch member for releasably retaining said cam pin against relative displacement along said cam slot, and a manually operated latch lever for retracting said latch member from said cam pin to permit displacement of said cam pin along said cam slot, said latch member including a latch plate pivotally mounted onto said carrier link, said latch plate having a notch therein for receiving and retaining said cam pin, a spring for biasing said latch plate in a direction receiving said cam pin within said notch, and a control cable connected between said latch plate and said latch lever for retracting said latch plate from said cam pin.

11. The recliner chair of claim 10 further including a legrest, said recliner linkage including means for moving said legrest between a retracted position when said seat and seatback are in said generally upright position, and an elevated position when said seat and seatback are in said reclined position, said legrest moving means comprises means for orienting said legrest substantially coplanar with said seat when said seat and seatback are in said substantially coplanar horizontal position.

12. The recliner chair of claim 10 further including at least one armrest unit mounted on said chair frame for movement between a deployed position elevated above said seat at one side thereof, and a lowered position disposed substantially coplanar with said seat when said seat and seatback are in said substantially coplanar horizontal position.

13. A recliner chair, comprising:

a chair frame;

a seat;

a seatback;

a recliner linkage including a seat link mounted on said seat, and means for movably supporting said seat link and said seatback for movement between a generally upright position and at least one reclined position with said seat link tilted upwardly toward a front of the chair frame and with said seatback tilted rearwardly, said supporting means including a carrier link and means for pivotally connecting said carrier link generally to a rear end of said seat link;

said pivotally connecting means including latch means normally engaged for pivotally connecting said carrier link with said seat link so that said seat link follows said carrier link upon operation of said recliner linkage for movement between said upright and reclined positions;

said latch means being releasable to permit relative sliding displacement between said seat link and said carrier link for movement of said seat from said reclined position to a substantially horizontal position;

said recliner linkage further including means for permitting displacement of said seatback from said reclined position to a substantially horizontal position oriented substantial coplanar with said seat upon movement of said seat from said reclined position to said substantially horizontal position;

said latch means including a cam slot formed in said carrier link, a cam pin on said seat link and received within said cam slot, a spring-loaded latch member for releasably retaining said cam pin against relative displacement along said cam slot, and a manually operated latch lever for retracting said latch member from said cam pin to permit displacement of said cam pin along said cam slot; and at least one armrest unit mounted on said chair frame for movement between a deployed position elevated above said seat at one side thereof, and a lowered position disposed substantially coplanar with said seat when said seat and seatback are in said substantially coplanar horizontal position.

14. The recliner chair of claim 13 including a pair of armrest units disposed at opposite sides of said seat, and further including a tray and means for removably mounting said tray to said armrest units.

15. A recliner chair, comprising:

a chair frame;

a seat;

a seatback; and a recliner linkage including a seat link mounted on said seat, and means for movably supporting said seat link and said seatback for movement between a generally upright position and at least one reclined position with said seat link tilted upwardly toward a front of the chair frame and with said seatback tilted rearwardly, said supporting means including a carrier link and means for pivotally connecting said carrier link generally to a rear end of said seat link;

said pivotally connecting means including latch means normally engaged for pivotally connecting said carrier link with said seat link so that said seat link follows said carrier link upon operation of said recliner linkage for movement between said upright and reclined positions;

said latch means being releasable to permit relative sliding displacement between said seat link and said carrier link for movement of said seat from said reclined position to a substantially horizontal position;

said recliner linkage further including means for permitting displacement of said seatback from said reclined position to a substantially horizontal position oriented substantial coplanar with said seat upon movement of said seat from said reclined position to said substantially horizontal position;

said seatback including at least one lift bar for engaging an undersurface of a rear edge of said seat upon movement of said seatback to said horizontal position for lifting said seat to said horizontal position substantially coplanar with said seatback; and at least one armrest unit mounted on said chair frame for movement between a deployed position elevated above said seat at one side thereof, and a lowered position disposed substantially coplanar with said seat when said seat and seatback are in said substantially coplanar horizontal position.

* * * * *